United States Patent [19]

Jines

[11] 4,272,031

[45] Jun. 9, 1981

[54] VEGETATION PULVERIZER

[76] Inventor: Chester G. Jines, 1980 SE. Spruce, Hillsboro, Oreg. 97123

[21] Appl. No.: 6,550

[22] Filed: Feb. 21, 1979

[51] Int. Cl.[3] ..... B02C 23/36

[52] U.S. Cl. ..... 241/46.17; 241/282.1

[58] Field of Search ..... 241/46.17, 199.12, 282.1, 241/282.2; 239/310, 142

[56] References Cited

U.S. PATENT DOCUMENTS

| | | | |
|---|---|---|---|
| 2,599,678 | 6/1952 | Walker | 239/310 |
| 3,716,066 | 2/1973 | Currier et al. | 239/142 X |
| 4,026,673 | 5/1977 | Russo | 239/310 X |
| 4,054,519 | 10/1977 | Tufts | 241/46.17 X |
| 4,114,815 | 9/1978 | Gissbers | 241/46.17 X |

*Primary Examiner*—Howard N. Goldberg
*Attorney, Agent, or Firm*—Eugene M. Eckelman

[57] ABSTRACT

An upright tank has an upper loading opening with a first horizontal wall therein spaced downwardly from the top. The horizontal wall has a central opening and an inverted frusto-conical guide extends upwardly for guiding material to be treated toward the opening. The upper portion of the tank has a fluid inlet. A horizontally operating cutter blade is disposed adjacent the opening in the horizontal wall, and such cutter blade initially cuts and shreds material received down the guide for producing a slurry. A second horizontal wall is disposed below the first wall to form a compartment therebetween and a cutter-impeller assembly is provided in this compartment to receive the slurry from the cutter blade and further reduce the material and mix it with fluid from the fluid inlet to provide a resulting readily flowable slurry. A driven shaft operates the cutter blade and cutter-impeller assembly and an outlet is radially disposed through which the slurry is discharged. The tank may be sealed at the top and provided with pressurized fluid. Such pressurized fluid may be accomplished by connection to a conventional garden hose.

4 Claims, 2 Drawing Figures

VEGETATION PULVERIZER

FIELD OF INVENTION

This invention relates to new and useful improvements in vegetation pulverizers.

SUMMARY OF THE INVENTION

A primary objective of the invention is to provide a vegetation pulverizer that employs means arranged to receive vegetation and fluid and arranged to comminute said vegetation and produce a slurry that can be spread on the ground, thus converting waste material such as lawn clippings into a slurry form that can be transferred directly back to the ground.

Another object of the invention is to provide a pulverizer of the type described which is simplified in structure, economical to manufacture, easily portable, and one that is designed for use by the usual homeowner or gardener.

Still another object is to provide a pulverizer of the type described which employs a novel arrangement of cutter blades and associated fluid inlet and outlet for producing the said slurry. Structure for carrying out the objectives comprises an upright tank with a top loading opening. The tank has a first horizontal wall spaced downwardly from the top which has a central opening. An inverted frusto-conical guide extends upwardly from the wall for guiding material to be treated toward said opening. Fluid inlet means are provided adjacent an upper portion of the tank for admitting fluid such as water from a garden hose. A horizontally operating cutter blade is disposed adjacent the opening for initially cutting and shredding material received down the guide. A second horizontal wall is disposed below the first horizontal wall to form a compartment therebetween, and cutter and impeller means are disposed in this compartment for receiving the slurry from the cutter blade and for further reducing the material and mixing it with fluid. The cutter blade and cutter and impeller means are mounted on an upright powered shaft, and an outlet is radially disposed with relation to the cutter and impeller means through which the latter forces the slurry out of the tank.

DETAILED DESCRIPTION OF A PREFERRED EMBODIMENT

Figure 1:
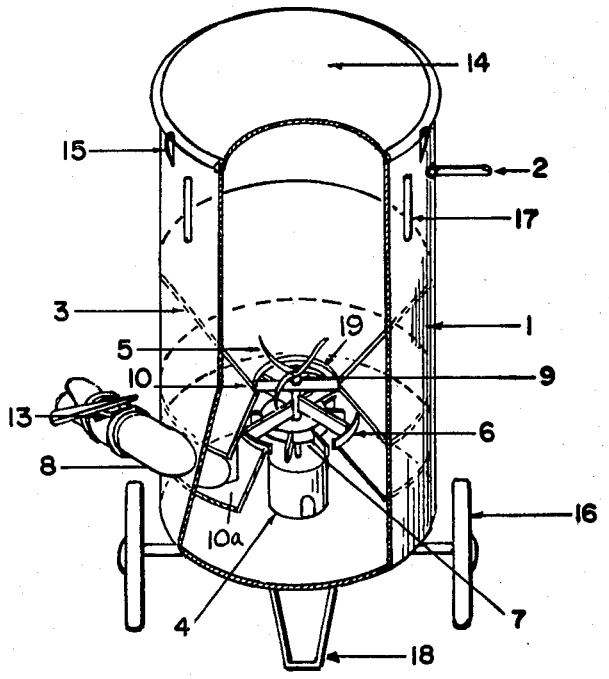
FIG. 1 is a perspective view of the present pulverizer, a portion of the tank, lid and internal structure being broken away for clarity.
Figure 2:
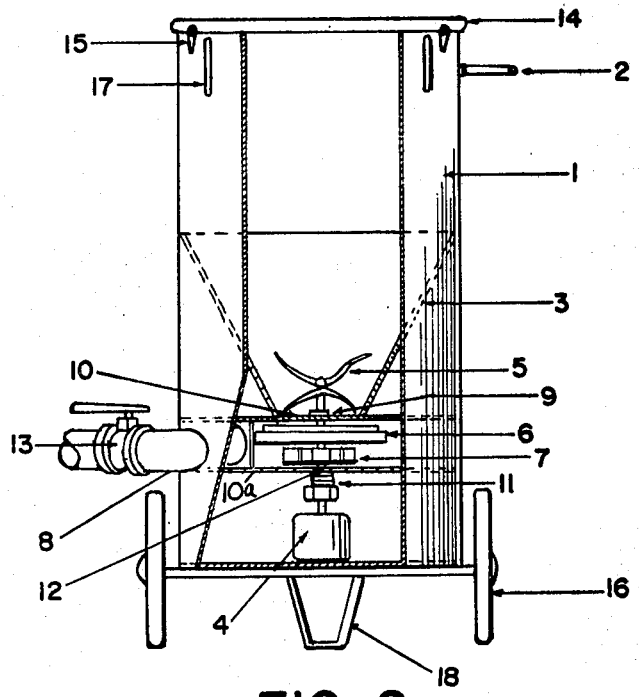
FIG. 2 is an elevational view of the pulverizer also with portions thereof broken away.

With particular reference to the drawings, the pulverizer and spreader of the present invention comprises an upright tank 1 preferably supported on wheels 16 for portability and having a foot member 18 for stabilizing the tank on the ground. Tank 1 has a removable lid 14 which is clamped in place by clamps 15. With the lid removed, material to be comminuted is fed through the top opening of the tank, it being preferred that the lid 14 have a tight seal with the tank. A fluid inlet 2, such as a suitable fitting for connection to a garden hose, is provided adjacent an upper portion of the tank. Handles 17 are provided on the tank for transporting the assembly.

An inverted frusto-conical feed tube 3 is provided inside the tank below the top opening which is arranged to direct material to be comminuted as well as fluid from inlet 2 into a central portion of the tank. Feed tube 3 is secured at the bottom to a horizontal wall 10 having a central opening 19 aligned with the bottom opening of the feed tube 3. A second horizontal wall **10*a* is secured in the tank in spaced relation below the wall 10 and forms a compartment therebetween. An outlet 8 extends from the tank in radial alignment with the compartment between the two walls, and such outlet has a control valve 13** therein.

Power means 4 such as an electric or gas motor, is supported on the bottom of the tank and has a vertical drive shaft 12 to which are keyed an upper or first cutter blade assembly 5, a second or lower cutter blade assembly 6, and an impeller assembly 7. Shaft 12 has suitable bearing means 9 connected to the wall 10 and bearing means 11 connected to the wall **10*a*** for journaled support of the shaft.

Upper blade assembly 5 comprises a plurality of cutter blades of suitable shape for reducing the material to a finer state. Such blades are disposed above the wall 10. After being initially reduced, the material is directed downwardly into the blade assembly 6 disposed in the compartment between the two walls 10 and **10*a* where it is further reduced. The impeller assembly 7** is also located in the compartment between the two horizontal walls, and the material received from the second blade is forced out the outlet.

In operation, material to be comminuted is deposited in the tank 1 and water admitted. The blade assembly 5 provides a first reduction of the material in the slurry and the blade assembly 6 provides another reduction whereby the final product comprises a slurry with finely ground particles which can be deposited back onto the ground. The inlet through the fitting 2 and valved outlet 8 can be arranged such that with a sealed engagement of lid 14 on the tank, a pressured system can be provided.

Having thus described my invention, I claim:

1. A vegetation pulverizer and spreader comprising (a) an upright tank having an upper loading operation, (b) a first horizontal wall in said tank spaced downwardly from the top of said tank, (c) a central opening in said wall, (d) an inverted frusto-conical guide extending upwardly from said wall for guiding material to be treated toward said opening, (e) fluid inlet means adjacent an upper portion of said tank for admitting fluid, (f) a horizontally operating cutter blade disposed adjacent said central opening for initially cutting and shredding material received down said guide for producing a slurry, (g) a second horizontal wall below said first horizontal wall forming a compartment therebetween, (h) cutter and impeller means in said compartment arranged to receive the slurry from said cutter blade and further reduce the material and mix it with fluid to provide a resulting readily flowable slurry in said compartment, (i) an upright power driven shaft in said tank driving said cutter blade and said cutter and impeller means, (j) and an outlet radially disposed with relation to said cutter and impeller means through which the latter forces the resulting slurry.

2. The vegetation pulverizer of claim 1 including a lid on said tank arranged to seal said loading opening, said fluid inlet means being arranged to receive pressurized fluid whereby the movement of the material being treated through said tank is assisted by fluid pressure.

3. The vegetation pulverizer of claim 2 wherein said fluid inlet means is arranged for connection to a conventional garden hose.

4. The vegetation pulverizer of claim 1 wherein said cutter and impeller means comprises a second cutter blade for further reducing the material and an impeller blade disposed in a plane below said second cutter blade.

* * * * *